US005733177A

United States Patent [19]

Tsuchiya et al.

[11] Patent Number: 5,733,177

[45] Date of Patent: Mar. 31, 1998

[54] PROCESS OF POLISHING WAFERS

[75] Inventors: Toshihiro Tsuchiya; Kouichi Tanaka; Kiromasa Hashimoto; Kouji Morita; Tsutomu Takaku, all of Nishigou-mura, Japan

[73] Assignee: Shin-Etsu Handotai Co., Ltd., Tokyo, Japan

[21] Appl. No.: 688,174

[22] Filed: Jul. 29, 1996

[30] Foreign Application Priority Data

Aug. 1, 1995 [JP] Japan ..... 7-215242

[51] Int. Cl.[6] ..... B24B 7/04

[52] U.S. Cl. ..... 451/41; 451/285; 451/287; 451/288

[58] Field of Search ..... 451/36, 41, 285, 451/287, 288, 289

[56] References Cited

U.S. PATENT DOCUMENTS

| | | | |
|---|---|---|---|
| 4,680,893 | 7/1987 | Cronkhite et al. | 451/41 |
| 4,692,223 | 9/1987 | Lampert et al. | 451/41 |
| 4,869,779 | 9/1989 | Acheson . | |
| 5,230,184 | 7/1993 | Bukhman | 451/41 |
| 5,486,265 | 1/1996 | Salugsugan | 451/287 |

OTHER PUBLICATIONS

Kolenkow et al., "Chemical–Mechanical Wafer Polishing and Planarization in Batch Systems", *Solid State Technology*, vol. 35, No. 6, pp. 112–114 (Jun., 1992).

Abstract of Japanese Publication No. JP 72–21054.

Abstract of Japanese Publication No. JP 61–120424.

Abstract of Japanese Publication No. JP 51–77534.

Abstract of Japanese Publication No. JP 52–85854.

Abstract of Japanese Publication No. JP 63–267159.

*Primary Examiner*—Eileen P. Morgan

*Attorney, Agent, or Firm*—Evenson, McKeown, Edwards & Lenahan P.L.L.C.

[57] ABSTRACT

The invention concerns a process of polishing wafers, in which a silicon wafer held on a wafer support plate rotatable under a predetermined applied pressure, is polished by mechanochemical polishing in a plurality of polishing steps with an abrasive material interposed between the wafer and a polishing pad cloth applied to a polishing surface plate moved relative to the wafer support plate at a predetermined relative speed. Quality comparable to that of wafers obtainable by a prior art three-step polishing process can be obtained with a two-step wafer polishing step comprising a primary polishing step and a final polishing step. The primary polishing step is performed by setting a high polishing pressure of 300 to 700 g/cm$^2$ and a reference relative speed of 50 to 150 m/min., and quick increase of the relative speed to 2 to 4 times and quick reduction of the polishing pressure down to ½ to ⅒ are caused in a final stage of the primary polishing step. The final polishing step is performed by setting a reference polishing pressure of 100 to 400 g/cm$^2$ and a reference relative speed of 50 to 150 m/min., and in its final stage the relative speed is quickly reduced to ½ to ⅕.

12 Claims, 4 Drawing Sheets

PROCESS OF POLISHING WAFERS

BACKGROUND OF THE INVENTION

1. Field of the Invention

This invention relates to a process of polishing semiconductor wafers and, more particularly, to a process of mechanochemical polishing of silicon wafers with effective control of the relative speeds of work wafer and polishing pad and the polishing pressure.

2. Description of the Related Art

Mechanochemical polishing process which is adopted for polishing silicon wafers (hereinafter being referred to as wafers), is principally brought about by the following polishing mechanism.

The process is brought about by using an abrasive material, which is prepared by colloidally suspending superfine particles of $SiO_2$ with average grain size of 100 nm or below as abrasive grain in an aqueous alkali solution having a chemical action on the wafers, and also using a soft polyester cloth, a polyurethane cloth or a non-woven fiber cloth as polishing pad. The process is free from rubbing of the wafer surface, and dissolution products accumulated on the wafer surface are removed with friction of the superfine particles noted above, while also chemically removing working damage on the wafer surface. In this way, mirror finished surface free from working defects can be obtained.

During polishing, the abrasive grain in the abrasive material between the wafer surface and polishing pad, generates strain energy accompanying elastic deformations and also heat of friction. This has an effect of making the wafer surface to be chemically active and thus promoting dissolution based on the alkali solution. Dissolution products are thus accumulated in the vicinity of the wafer surface, and viscous solution is generated in the wafer surface vicinity. The superfine particles of $SiO_2$ as abrasive grain remove the dissolution products to maintain dissolution based on the chemically active state noted above. Described so far is the summary of the mechanism of mechanochemical polishing.

In order to increase the efficiency of polishing by the mechanochemical polishing process, therefore, it is necessary to maintain the chemically active state, which is provided by temperature rise due to mechanical action between the wafer surface on one and the abrasive grain and polishing pad on the other hand, and also remove the dissolution products generated by the chemical activation from the wafer surface. In order to obtain a high accuracy, high quality wafer surface, on the other hand, it is necessary to remove the dissolution products from the vicinity of the wafer without having mechanically adverse effects thereon.

Up to date, silicon wafers are required to be greater in diameter and higher in accuracy and quality in spite of an opposite demand for increasing their production efficiency. Particularly, for higher accuracy and higher quality the wafer surface should have less working damage and less polished surface roughness while being highly flat. To meet this end, the wafer surface is mirror finished in a polishing process comprising a plurality of steps.

The mirror finishing of wafers is done by using the mechanochemical polishing process noted above (mechanical chemical composite polishing process). As described before, in this process dynamic action of mechanical polishing and chemical action of chemical etching are combined to provide a composite effect for obtaining a high efficiency, high accuracy mirror finished surface. The polishing properties of the process are influenced by apportionment of mechanical and chemical elements during the polishing process.

Specifically, in an initial stage of the polishing process the action of the mechanical element is provided greatly to provide high flatness in high efficiency, and in the final stage it is reduced the action of the mechanical element to improve the surface roughness. In this way, highly accurate mirror finishing free form working damage is obtained.

FIG. 1(A) shows a polishing apparatus for carrying out the above mechanochemical polishing. The apparatus comprises a rotatable polishing surface plate 13 with a polishing pad 14 applied thereto and a rotatable wafer support plate 11 for supporting a wafer 12 mounted thereon. The wafer 12 and the polishing pad 14 are moved at a certain relative speed with abrasive material 15 interposed between them, and the wafer 12 is thus polished by mechanochemical polishing process based on frictional motion between it on one hand and the abrasive grain 17 and polishing pad 14 under it on the other hand.

Liquid coolant 21 is supplied to the polishing surface plate 13 and wafer support plate 11 to adjust the working temperature rise due to heat generated by the above frictional movement, thus preventing thermal deformation of the polishing surface plate 13 and the wafer support plate 11. A cooling air source 25 is further provided, which includes an air compressor 251, a pressure regulator 252 and a cooler 253. Compressed cooling air is supplied from the cooling air source 25 to be blown through a nozzle 201 against the polishing surface plate 13 (the blowing position being hereinafter referred to as air cooling station 20).

FIG. 1(B) is a top view showing the polishing surface plate 13. As shown, a polishing station 30, in which the wafer 12 is held, and the cooling station 20 for removing working heat generated during polishing of the wafer, are formed symmetrically with respect to the axis of rotation of the polishing surface plate 13, thus providing for uniform surface temperature distribution of the abrasive cloth 14 and permitting high flatness polishing.

FIG. 4 is a time chart showing the summary variation on the relative speed, polishing pressure, flatness, surface roughness and haze level in the prior art polishing process using the above apparatus. As shown, the process is a three-step process comprising a primary polishing step, a secondary polishing step and a final polishing step.

The primary and secondary polishing steps are performed by using colloidal silica as the abrasive grain and non-woven fiber cloth as the polishing pad. The relative speed is set to 100 m/min. as reference relative speed, and the polishing pressure is set to 500 g/cm$^2$. Toward the end of the primary polishing step, the flattening is substantially ended to secure a flatness of about 0.3 μm. The surface roughness at this time, is about 1 nm. The secondary polishing step is performed by changing the grain size of the colloidal silica. Toward the end of the secondary polishing step, a flatness of about 0.3 μm and a surface roughness of about 0.5 nm are obtained.

The final polishing step is performed by using the same colloidal silica abrasive material and polishing pad of suede type and by setting a reference polishing pressure of 340 g/cm$^2$ and a low relative speed of 40 m/min. In this step, a flatness of about 0.3 μm, a surface roughness of about 0.35 μm, and a haze level of 40 bits are obtained.

As noted before, as a recent trend of semiconductor wafers it is strongly desired to study a polishing process, which is expected to provide for high production efficiency while maintaining high accuracy and high quality.

SUMMARY OF THE INVENTION

An object of the invention is to provide a wafer polishing process comprised two polishing steps, in which it can ensure comparable quality with that of wafers finished in the prior art three-step wafer polishing process.

The above object of the invention is attained by a process of polishing wafers, in which a silicon wafer held by a wafer surface rotated under a predetermined applied pressure is polished by mechanochemical polishing in a plurality of polishing steps with an abrasive material interposed between the wafer and a polishing pad applied to a polishing surface plate moved relative to the wafer support plate at a predetermined relative speed, the plurality of polishing steps are composed not three-step wafer polishing process but two-steps being a primary polishing step and a final polishing step, increase of the relative speed of the polishing pad and wafer and reduction of the polishing pressure being brought about at the same time or step-wise in a final stage of primary polishing step.

The relative speed is the speed of the polishing pad relative to the wafer surface when polishing the wafer by causing relative movement of the wafer and the polishing pad each other, and it is usually represented by the distance covered in unit time.

Suitably, the primary polishing step is performed with a high polishing pressure of 300 to 700 g/cm$^2$ and a reference relative speed of 50 to 150 m/min., and a quick increase of the relative speed to 2 to 4 times and a quick reduction of the polishing pressure to ½ to ⅒ are done in the final stage of the primary polishing step.

Suitably, the final polishing step is performed with a reference polishing pressure of 100 to 400 g/cm$^2$ and at a reference relative speed of 50 to 150 m/min., and in a final stage of the final polishing step the relative speed is quickly reduced to ½ to ⅕.

According to the invention, with quick increase of the relative speed and accompanying quick reduction of the polishing pressure, done in the final stage of primary polishing step, it is possible to improve the polishing efficiency without adverse effects on the quality and omit the secondary polishing step in the prior art.

In addition, by adopting mechanochemical polishing using a suede type polishing pad having a high porosity in the final polishing step, it is possible to obtain mirror final polishing with high polishing efficiency and high quality (with an aim of reducing the haze level), while permitting prevention of haze generation with a reduced relative speed set for a short period of time in the final stage of the final polishing step. That is, it is possible to obtain wafers comparable in quality to those obtainable by the prior art process with a two-step polishing process, thus permitting improvement of the polishing efficiency and reduction of the manufacturing cost.

Figure 1A:
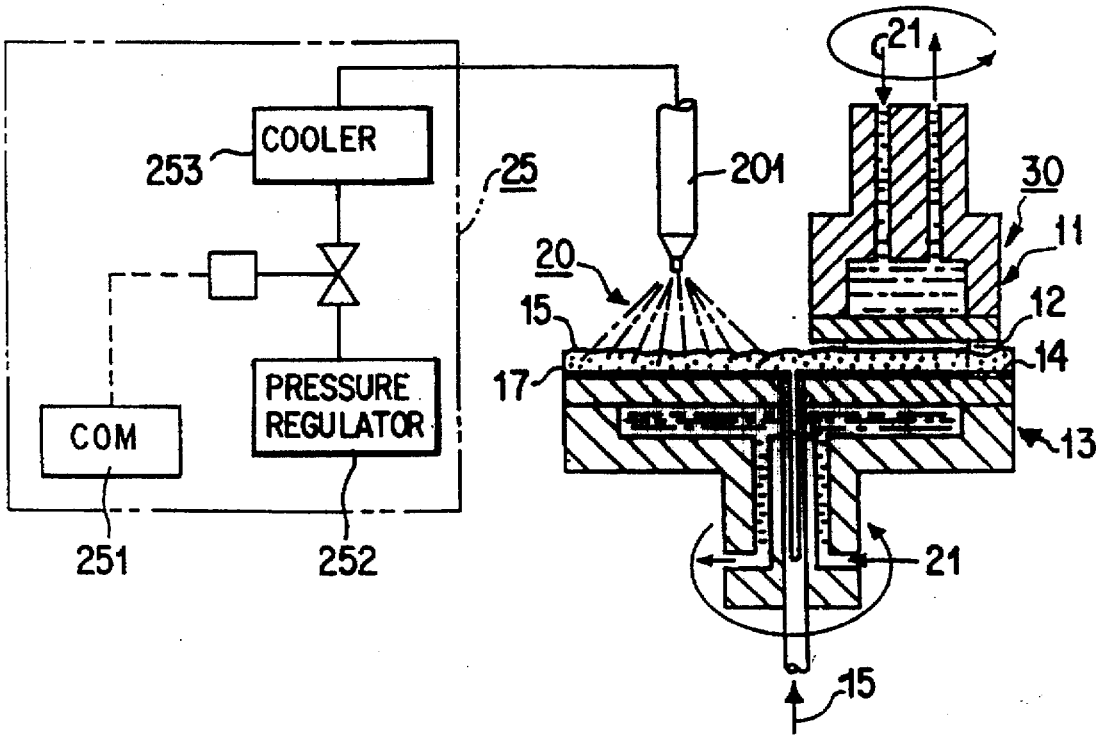
FIG. 1(A) is a schematic side view showing a polishing apparatus used for carrying out an embodiment of the invention.

Reference numerals: 11: wafer support plate , 12: wafer, 13: polishing surface plate, 14: polishing pad, 15: abrasive material, 17: abrasive grain, 20: cooling station, 21: liquid coolant, 31: polishing station.

DETAILED DESCRIPTION OF THE PREFERRED EMBODIMENT

The invention will now be described in detail with reference to the drawings.

Figure 4:
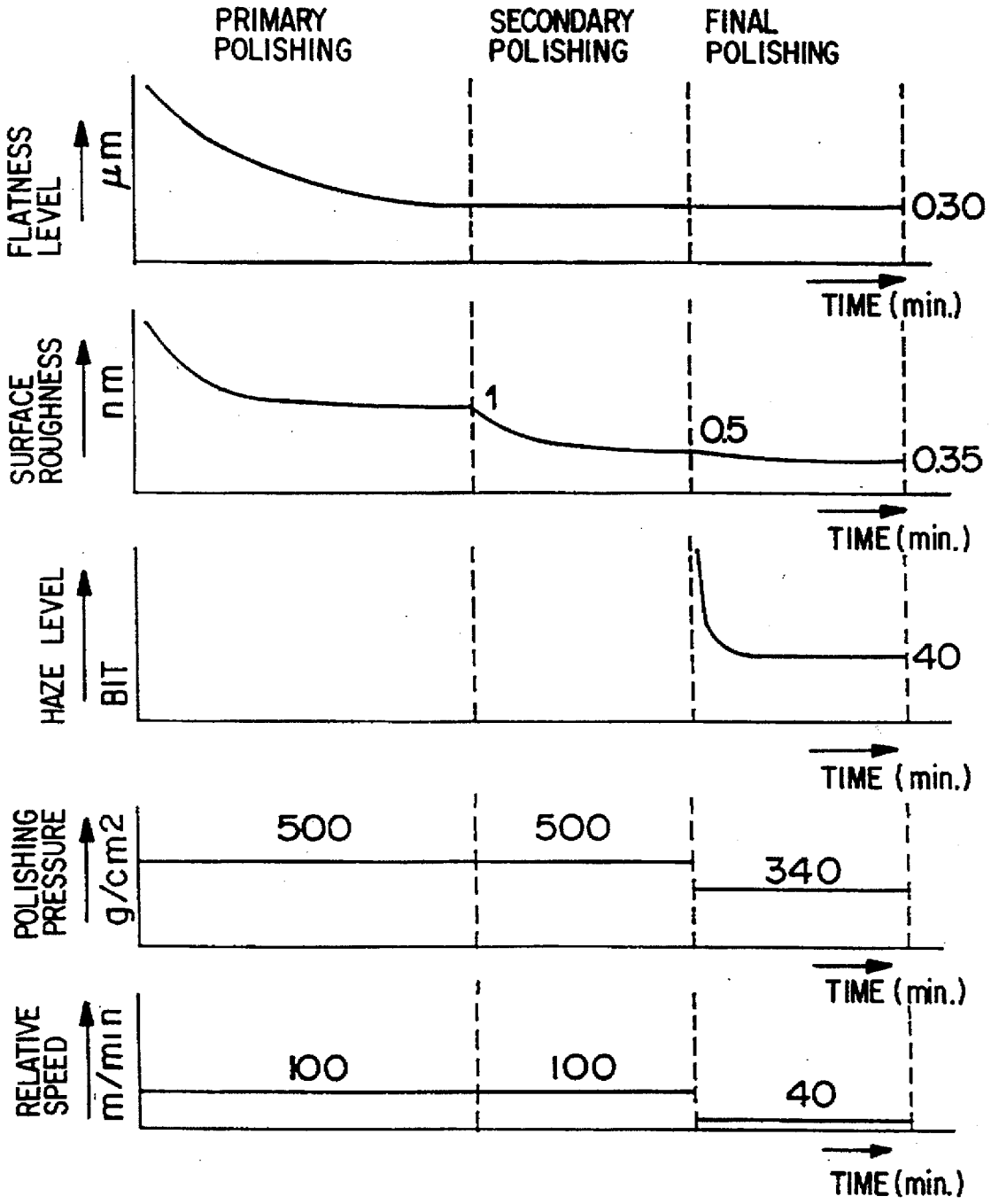
FIG. 4 is a time chart showing the summary variation on the relative speed, polishing pressure, flatness level, surface roughness and haze level in a prior art three-step polishing process.

From the time chart in FIG. 4 for the prior art mechanochemical polishing, the flattening of the wafer is mostly ended in the primary polishing step, and subsequently a flatness of about 0.3 μm is secured. Specifically, it will be seen that in the primary polishing step flattening mainly based on mechanical file effect is done, and subsequently the emphasis is switched over to polishing, which is a suitable combination of mechanical polishing and chemical polishing and has an aim of reducing the surface roughness and haze level.

Figure 2:
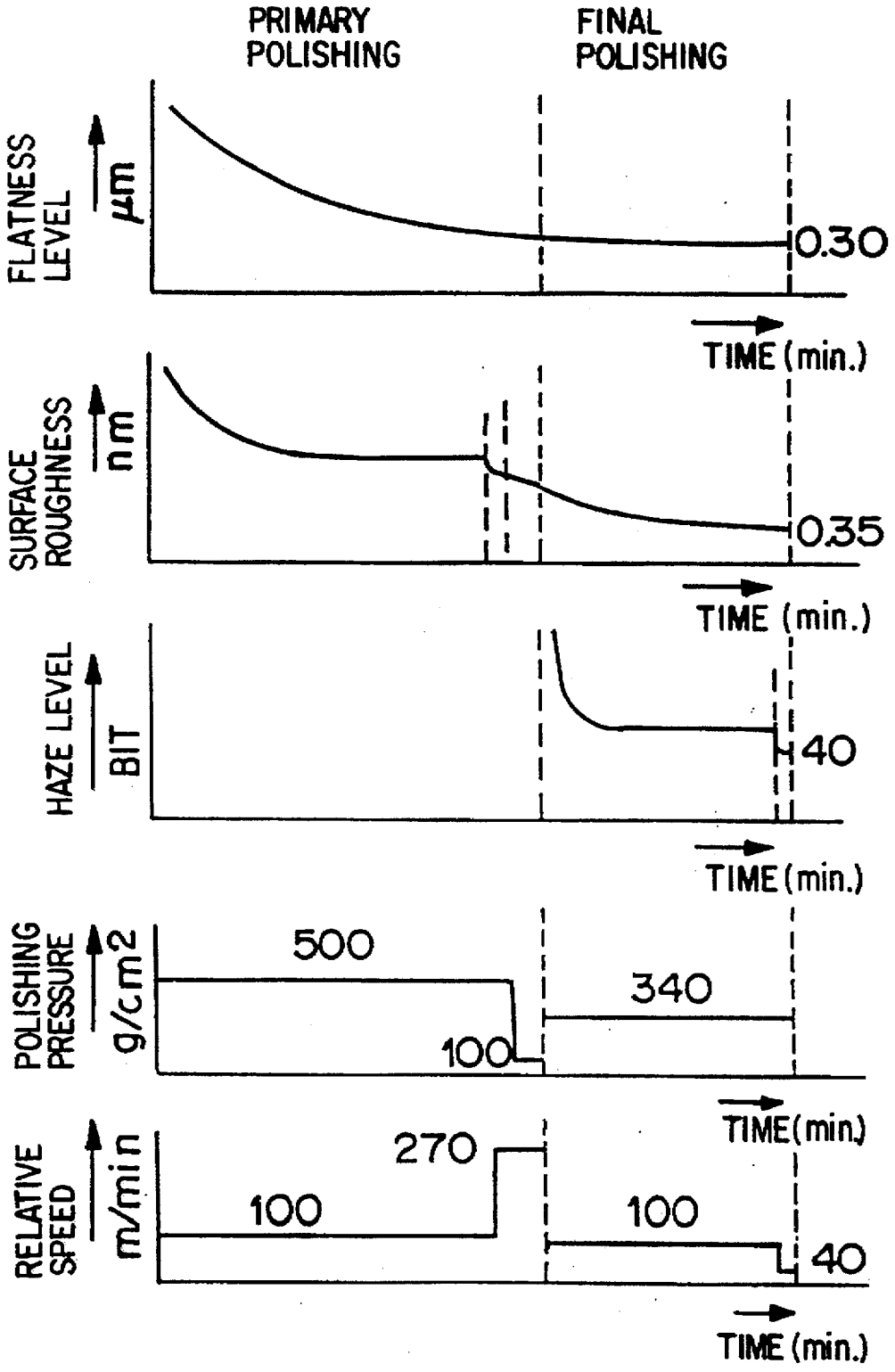
FIG. 2 is a time chart showing the summary variation on the relative speed, polishing pressure, flatness level, surface roughness and haze level in a two-step polishing process according to the invention.

More specifically, as shown in FIG. 2, according to the invention in most of the primary polishing step polishing mainly based on a mechanical file effect on the reference relative speed and high polishing pressure is done, and subsequently mechanical polishing and chemical polishing are suitably combined at the process after final stage. In order to establish and maintain a chemically active state and reduce the surface roughness of the wafer, the ambient temperature around the wafer surface and the clearance between the abrasive material and polishing pad should be in the best situation.

In a final stage in the primary polishing step, the relative speed is switched over to a higher one for enhancing chemical polishing owing to temperature rise, and also the polishing pressure is switched over to a lower one for weakening mechanical polishing.

The higher relative speed and the lower polishing pressure are set for the purpose of generating a hydroplane phenomenon.

In the subsequent final polishing step, in order to prevent polishing efficiency reduction due to chemical polishing, which was overwhelmingly seen in the prior art final polishing step, the reference relative speed is reduced to provide for polishing mainly based on mechanical polishing only for a short period of time in a final stage of the step, thus preventing (or reducing) generation of haze during this period.

In the process for polishing wafers according to the invention, in which a wafer held by a wafer support plate rotated under an adequate polishing pressure is polished by mechanochemical polishing in a plurality of polishing steps with an abrasive material interposed between the wafer and a polishing pad applied in a polishing surface plate moved relative to the wafer support plate at a adequate relative speed, the plurality of polishing steps being a primary polishing step and a final polishing step, in a final stage of flattening mainly based on a mechanical file effect provided by reference relative speed and high polishing pressure in the primary polishing step, quick increase of the relative speed for quickly providing chemical action and quick reduction of the polishing pressure for reducing mechanical effects on the wafer surface when removing dissolution products formed by the chemical action in the vicinity of the wafer surface, are done at the same time to effectively realize quick surface roughness reduction and polishing efficiency improvement and also permit reduction of the polishing process.

The final polishing step is done by using a polishing pad of suede type having a high porosity with high abrasive grain holding property, is initially performed to effect chemical polishing for most part of it to secure a predetermined surface roughness, and in its final stage a reduced reference relative speed is set for a short period of time for mainly mechanical polishing therein to prevent (or reduce) generation of haze.

In a typical embodiment, the primary polishing step is performed by using an abrasive material containing colloidal silica as abrasive grain and a non-woven polishing pad, its most part is done with a high polishing pressure of about 500 g/cm$^2$ and a reference relative speed of about 100 m/min., and in its final stage quick increase of high the relative speed and quick reduction of the low polishing pressure are caused to obtain quick reduction of the surface roughness, improvement of the polishing efficiency and consequent reduction of the polishing step.

The final polishing step is performed by using the same abrasive material containing colloidal silica as abrasive grain and a polishing pad of suede type having a high porosity with high abrasive grain holding property, and for its most part a reference polishing pressure of about 340 g/cm$^2$ and a reference relative speed of about 100 m/min. are set to secure the final surface roughness. In a final stage of this step, a reduced relative speed is set for a short period of time for obtaining a balance between the mechanical action and chemical action and permitting haze-free working.

With the technical constitution as described above, the following effects can be obtained.

(1) With quick increase of the relative speed caused in the final stage of the primary polishing step, a hydroplane phenomenon is brought about by quick polishing pressure reduction caused subsequently after a time delay, for preventing quality deterioration and permitting polishing process reduction.

(2) With the final polishing step performed by using the suede type polishing pad having high porosity and with chemical polishing proceeded initially for most part of the step, increased polishing efficiency can be maintained in addition to abrasive grain holding efficiency improvement. In addition, with a reduced relative speed set for a short period of the final stage in the step, the polishing is brought to one mainly based on mechanical polishing, thus preventing generation of haze.

A suitable embodiment of the invention will be described in detail with reference to the drawings. Unless particularly specified, however, the sizes, shapes, relative positions, etc. of parts described in the embodiment are given without any sense of limiting the invention but are merely exemplary.

Figure 1B:
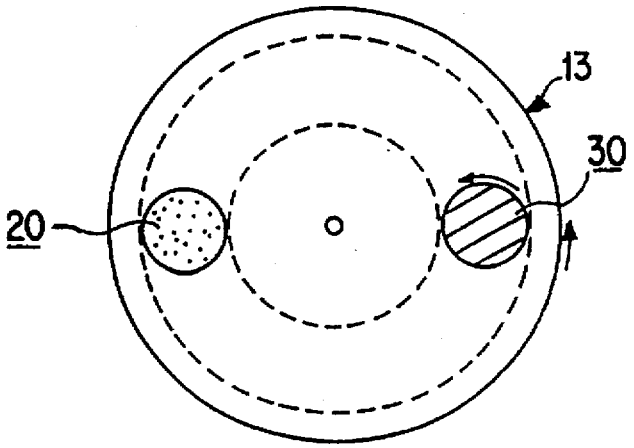
FIG. 1(B) is a schematic top view showing a polishing surface plate in the same apparatus.

FIGS. 1(A) and 1(B) briefly show the polishing apparatus for polishing wafers in the two-step polishing process according to the invention. The apparatus itself is a conventional one. FIG. 2 is a time chart showing the summary variation on the relative speed, polishing pressure, flatness level, surface roughness and haze level in polishing of wafer in the embodiment of the two-step polishing process according to the invention.

In the polishing apparatus as shown in FIG. 1(A), comprising a wafer support plate 11 and a polishing surface plate 13 both rotatable in the respective directions of arrows, a polishing pad 14 is applied to the polishing surface plate 13, and a wafer 12 is mounted on the wafer support plate 11. The wafer 12 and the polishing pad 14 are moved relatively at a relative speed with abrasive material 15 provided between them.

The wafer 12 is polished by mechanical-chemical polishing with frictional movement between it and the abrasive grain 17 in the abrasive material 15 and the polishing pad 14 under it. Liquid coolant 21 is supplied to the polishing surface plate 13 and the wafer support plate 11 to control working temperature increase due to heat of friction generated by the above frictional movement, thus preventing thermal deformation of the polishing surface plate 13 and the wafer support plate 11. A cooling air source 25 is further provided. As shown schematically in FIG. 1(B), a polishing station 30, in which the wafer 12 is supported, and a cooling station 20 for removing working heat generated during polishing of wafer, are formed on the polishing surface plate 13 in symmetrical positions with respect to the axis of rotation of the polishing surface plate 13. The surface temperature distribution over the polishing pad 14 is thus made uniform, thus permitting polishing to provide high flatness.

The cooling air source 25 includes an air compressor 251 for supplying compressed air, a pressure regulator 252 and a cooler 253.

The wafer polishing process according to the embodiment of the invention, as shown in FIG. 2, comprises a primary polishing step and a final polishing step.

The primary polishing step is performed by using a non-woven polishing pad as the polishing pad 14 and also using as the abrasive material 15 a suspension of colloidal silicas in an aqueous alkali solution having chemical action on wafer for initially providing for flattening mainly based on mechanical file effect with a reference relative speed of 100 m/min. and a high polishing pressure of 500 g/cm$^2$. When the flattening is ended in a final stage, the relative speed is quickly increased to 270 m/min. to provide for quick activation as composite chemical action obtained with suitable combination of mechanical polishing and chemical polishing.

It is intended to generate a hydroplane phenomenon with composite action of the relative speed increase and low polishing pressure reduction. It is considered that with the hydroplane phenomenon the polishing pad and the wafer are slightly separated from each other, so that the surface roughness of the former is not transferred as surface roughness (ripples) to the latter side but is reduced.

Subsequent quick reduction of low the polishing pressure to 100 g/cm$^2$ caused after slight delay time, has an effect of removing the dissolution products without causing damage to the wafer surface, thus maintaining the chemical activity. The dissolution products can be removed without substantial possibility of direct rubbing of the wafer surface because the abrasive grain 17 of $SiO_2$ in the abrasive material are fine particles and also because the non-woven polishing pad 14 is soft. It is thus possible to obtain a surface roughness of about 0.75 nm.

At this time, a hydroplane phenomenon produced in the wafer by the dynamic pressure effect of fluid has an effect of reducing the effects the surface roughness due to the file effect of the polishing pad 14 on.

The final polishing step is performed by using as the polishing pad 14 one of suede type polishing pad having a high porosity with high abrasive grain holding property and as the abrasive material 15 the same one as noted above obtained by suspending colloidal silica in a weak aqueous alkali solution. For this step, a reference relative speed of 100 m/min. and a reference polishing pressure of 340 g/cm$^2$ are set, and preference is given to chemical polishing.

Figure 3:
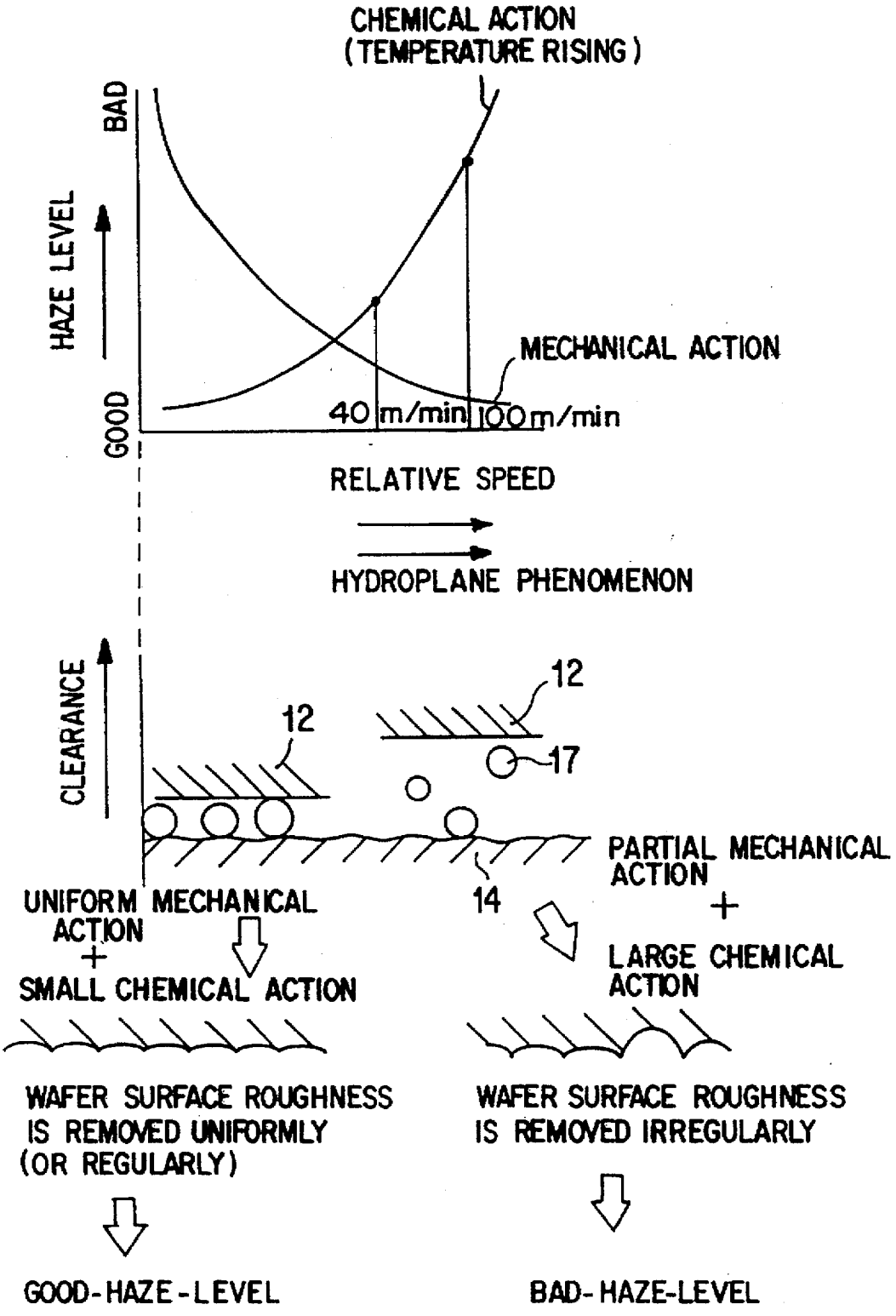
FIG. 3 is a graphic representation of the relation between haze and relative speed in a final polishing step shown in FIG. 2 and also of the clearance between wafer and polishing pad.

The above polishing is adapted to be mirror finishing making use of chemical reaction induced by mechanical energy at the point of contact between the fine particles of $SiO_2$ and the wafer. In the final stage of the step, a reduced relative speed of 40 m/min. is set for a short period of time to cause polishing based on mechanical polishing. Thus, as shown in FIG. 3, generation of haze is prevented, and at the end of the final polishing step a wafer is obtained, which has a flatness about of 0.3 μm, a surface roughness of about 0.35 nm, and a haze level of about 40 bits.

The use of the polishing pad 14 which is of suede type having a high porosity, permits flow of the abrasive material 15 containing the abrasive grain 17 in correspondence to the relative speed. Fine particles under the wafer 12 thus bring about the hydroplane phenomenon, thus holding a large clearance between the wafer and the polishing pad 14 without causing mechanical damage to the wafer as shown in FIG. 3. The clearance is not reduced but is maintained by the setting of the reduced relative speed for the short period of time noted above, thus preventing generation of haze by the abrasive grain 17.

The high porosity suede type polishing pad used according to the invention has a porosity of 400 to 600 forms/mm$^2$, which is about double the porosity of the usual suede type polishing pad, i.e., 200 to 300 forms/mm$^2$. Thus, it is considered to have excellent capacity of holding abrasive grain, which is effective for polishing efficiency improvement.

The average grain size of the colloidal silica grain in the abrasive materials used for the primary and final polishing steps, is set to 10 to 50 nm. Of course the grain size is set to be greater for the primary polishing step than for the final polishing step.

The haze is a measure of fine surface roughness such as to cause scattering of light under a focal beam lamp, the surface roughness being measured by Particle Counter Model "LS-6030" (manufactured by Hitachi DECO) using a measurement mode called "Haze Mode", and represented by a value obtained by proportionally converting the intensity of the scattered light to a corresponding voltage.

What is claimed is:

1. A process for polishing a silicon wafer comprising a primary polishing step and a final polishing step, wherein a silicon wafer is disposed on a wafer support plate and contacted with a polishing pad disposed on a polishing surface plate with an abrasive material interposed between the wafer and the polishing pad, said primary polishing step comprising rotating one of said polishing pad and said wafer relative to the other at a first relative speed and under a first applied pressure in an initial stage of said primary polishing step, and then increasing the relative speed and decreasing the applied pressure in an end stage of said primary polishing step.

2. A process according to claim 1, wherein the increase of the relative speed and the decrease of the applied pressure in said end stage of said primary polishing step are effected simultaneously.

3. A process according to claim 1, wherein the increase of the relative speed and the decrease of the applied pressure in said end stage of said primary polishing step are effected successively.

4. A process according to claim 1, wherein in said end stage of said primary polishing step the relative speed is increased to from 2 to 4 times said first relative speed and the applied pressure is decreased to from ½ to 1/10 of said first applied pressure.

5. A process according to claim 1, wherein in the initial stage of said primary polsihing step said first relative speed is in the range from 50 to 150 m/min, and said first applied pressure is in the range from 300 to 700 g/cm$^2$, and in the end stage of said primary polishing step the relative speed is increased to from 2 to 4 times said first relative speed and the applied pressure is decreased to from ½ to 1/10 of said first applied pressure.

6. A process according to claim 1, wherein in an end stage of the final polishing step the relative speed is quickly decreased to from ½ to ⅕ of an initial relative speed in said final polishing step.

7. A process according-to claim 1, wherein in an initial stage of said final polishing step final polishing is carried out at an initial relative speed of from 50 to 150 m/min. and an applied pressure of from 100 to 400 g/cm$^2$, and in an end stage of said final polishing step the relative rotational speed is quickly decreased to ½ to ⅕ of the initial relative speed.

8. A process for mechanochemically polishing a silicon wafer comprising a primary polishing step and a final polishing step, wherein a silicon wafer is disposed on a wafer support plate and contacted with a polishing pad disposed on a polishing surface plate with an abrasive material interposed between the wafer and the polishing pad, said primary polishing step comprising rotating one of said polishing pad and said wafer relative to the other at a first relative speed and under a first applied pressure, and said primary polishing step including a final wafer flattening stage based on a mechanical abrasion effect, wherein in said final wafer flattening stage the relative speed between the polishing pad and the wafer is quickly increased to promote chemical polishing and the applied pressure between the polishing pad and the wafer is simultaneously quickly decreased to reduce mechanical abrasion effects.

9. A process for polishing a silicon wafer comprising a primary polishing step comprising contacting the wafer with a non-woven fiber cloth polishing pad with an abrasive material comprising abrasive grains of colloidal silica between the pad and the wafer, and rotating one of the wafer and the pad relative to the other under an applied polishing pressure of about 500 g/cm$^2$ and at an initial relative speed of about 100 m/min, wherein in an end stage of said primary polishing step the relative speed is quickly increased and the applied polishing pressure simultaneously is quickly decreased.

10. A process according to claim 9, further comprising a final polishing step; wherein in said process the silicon wafer is held by a wafer support plate and a polishing pad applied to a polishing surface plate is rotated under said applied polishing pressure relative to the wafer support plate with the abrasive material interposed between the wafer and the polishing pad, and wherein in a final stage of said final polishing step the relative speed between the wafer and the polishing pad is decreased for a short period of time to cause polishing mainly based on mechanical polishing.

11. A process according to claim 10, wherein in said final polishing step the polishing pad is a suede polishing pad having a high porosity with a high abrasive grain holding property, said final polishing step initially being carried out to cause chemical polishing so as to attain a predetermined surface roughness, and in a final stage of said final polishing step the relative rotational speed being decreased for a short period of time to cause polishing mainly based on mechanical polishing.

12. A process according to claim 10, wherein in said final polishing step the polishing pad is a suede polishing pad having a high porosity with a high abrasive grain holding property and the abrasive material comprises abrasive grains of colloidal silica, said final polishing step initially being carried out under an applied polishing pressure of about 340 $g/cm^2$ and at a relative speed of about 100 m/min to attain a final surface roughness, and in a final stage of said final polishing step the relative rotational speed being decreased for a short period of time.

* * * * *